US008405575B2

(12) United States Patent
Furukawa et al.

(10) Patent No.: US 8,405,575 B2
(45) **Date of Patent: *Mar. 26, 2013**

(54) PLASMA DISPLAY DEVICE AND DRIVING METHOD THEREOF

(75) Inventors: Isao Furukawa, Tama (JP); Makoto Onozawa, Yokohama (JP); Tomokatsu Kishi, Yamato (JP); Takashi Sasaki, Hiratsuka (JP)

(73) Assignee: Hitachi, Ltd., Tokyo (JP)

( * ) Notice: Subject to any disclaimer, the term of this patent is extended or adjusted under 35 U.S.C. 154(b) by 517 days.

This patent is subject to a terminal disclaimer.

(21) Appl. No.: 12/766,277

(22) Filed: Apr. 23, 2010

(65) Prior Publication Data

US 2010/0201680 A1 Aug. 12, 2010

Related U.S. Application Data

(63) Continuation of application No. 11/362,162, filed on Feb. 27, 2006.

(30) Foreign Application Priority Data

Feb. 28, 2005 (JP) ..... 2005-054459

(51) Int. Cl.
*G09G 3/28* (2006.01)

(52) U.S. Cl. ..... 345/60; 345/63; 345/55; 345/204

(58) Field of Classification Search ..... 345/60, 345/63, 55, 204
See application file for complete search history.

(56) References Cited

U.S. PATENT DOCUMENTS

| | | | |
|---|---|---|---|
| 6,803,888 | B1 | 10/2004 | Nakamura et al. |
| 6,809,708 | B2 | 10/2004 | Kanazawa et al. |
| 2002/0047589 | A1 | 4/2002 | Myoung et al. |
| 2002/0158822 | A1 | 10/2002 | Ishizuka et al. |
| 2004/0085262 | A1 | 5/2004 | Lee |
| 2005/0116888 | A1 | 6/2005 | Kim et al. |
| 2005/0264476 | A1 | 12/2005 | Kim et al. |

FOREIGN PATENT DOCUMENTS

| | | |
|---|---|---|
| CN | 1702715 | 11/2005 |
| JP | 2000-029431 | 1/2000 |
| JP | 2000-284745 | 10/2000 |
| JP | 2002-328648 | 11/2002 |
| JP | 2002-328649 | 11/2002 |
| JP | 2003-050562 | 2/2003 |
| KR | 2003-14097 | 2/2003 |
| KR | 2004-43148 | 5/2004 |
| KR | 2004-79346 | 3/2005 |

OTHER PUBLICATIONS

Office Action issued in Japanese Patent Application No. 2010-074077 on Aug. 17, 2010.

U.S. Appl. No. 11/362,162, filed Feb. 27, 2006, Isao Furukawa et al., Fujitsu Hitachi Plasma Display Limited.

*Primary Examiner* — William Boddie
*Assistant Examiner* — Leonid Shapiro
(74) *Attorney, Agent, or Firm* — Antonelli, Terry, Stout & Kraus, LLP.

(57) ABSTRACT

A driving method of a plasma display device, the plasma display device having a plurality of first and second electrodes disposed adjacent to each other and a plurality of third electrodes disposed so as to intersect with the first and second electrodes, the driving method includes providing a reset period, an address period and a sustain discharge period for driving of the plasma display device, applying to the second electrode in the reset period a voltage with a waveform in which an applied voltage value increases with time, shortening a sustain time of achieved potential of the voltage with the waveform when a first display ratio of an input video signal is low as compared with a second display ratio which is higher than the first display ratio.

10 Claims, 11 Drawing Sheets

PLASMA DISPLAY DEVICE AND DRIVING METHOD THEREOF

CROSS-REFERENCE TO RELATED APPLICATION

This application is a continuation application of U.S. application Ser. No. 11/362,162, filed Feb. 27, 2006, now allowed, and claims priority from Japanese Patent Application No. JP 2005-054459 filed on Feb. 28, 2005, the contents of which are incorporated by reference herein.

TECHNICAL FIELD OF THE INVENTION

The present invention relates to a plasma display device and a driving method thereof. More particularly, it relates to a plasma display device and a driving method thereof for driving a plasma display panel (PDP) by means of obtuse-wave reset (obtuse-wave reset pulse).

BACKGROUND OF THE INVENTION

In recent years, an AC plasma display device which performs a surface discharge has been put into practical use as a flat image display device, and it has been widely used as an image display device of a personal computer, a workstation and others, a wall-hung flat television, and a device for displaying advertisements, information and others. For example, in a recent three-electrode surface-discharge type plasma display device, since the discharge intensity becomes higher and the background light emission is increased when a reset is performed with rectangular waves, the reset is performed by obtuse waves so as to reduce the background light emission and improve the contrast.

However, even the plasma display device using such obtuse-wave reset is not satisfactory, and it is desired to further reduce the background light emission so as to further improve the contrast in order to provide higher-quality video images.

Conventionally, a plasma display device which performs a surface discharge has been put into practical use as a flat image display device, in which all pixels on a screen simultaneously emit light in accordance with display data. The plasma display device which performs a surface discharge has a structure in which a pair of electrodes are formed in an inner surface of a front glass substrate, and a rare gas is sealed therein. When a voltage is applied between the electrodes, the surface discharge occurs on the surfaces of a dielectric layer and a protection layer formed on the electrode surfaces, thereby generating ultraviolet rays. The inner surface of a rear glass substrate is coated with phosphors of three primary colors, red (R), green (G), and blue (B), and the color display is carried out when the phosphors are excited by the ultraviolet rays so as to emit light.

FIG. 1 is a diagram schematically showing an example of a conventional plasma display panel, in which a three-electrode surface-discharge AC plasma display panel is shown.

In FIG. 1, a reference numeral 10 denotes a plasma display panel (PDP), 11 denotes a front-side substrate (front substrate), 12 denotes a transparent electrode for an X electrode, 13 denotes a bus electrode for the X electrode, 14 denotes a transparent electrode for a Y electrode, 15 denotes a bus electrode for the Y electrode, 16 denotes a rear-side substrate (rear substrate), 17 denotes an address electrode, 18 denotes a barrier rib (rib), and 19R, 19G, and 19B denote phosphor layers. Note that, in the actual PDP 10, a dielectric layer and a protection layer are provided on the X electrode and the Y electrode, and a dielectric layer is provided on the address electrode. Further, the space between the front-side substrate 11 in which the X electrodes (12, 13) and the Y electrodes (14, 15) are provided and the rear-side substrate 16 in which the address electrodes 17 are provided is filled with a discharge gas such as a mixed gas of neon and xenon, so that the discharge space at an intersecting part of the X and Y electrodes and the address electrode forms one discharge cell.

FIG. 2 is a diagram showing an example of a grayscale driving sequence in a conventional plasma display device.

As shown in FIG. 2, in the grayscale driving sequence in the plasma display device, one field (frame) is comprised of a plurality of sub-fields (sub-frames) SF1 to SFn respectively having predetermined weights of luminance, and desired grayscale display is performed by the combination of the sub-fields. Specifically, as the plurality of sub-fields, for example, eight sub-fields SF1 to SF8 having luminance weights in powers of 2 (ratio of the times of sustain discharge is 1:2:4:8:16:32:64:128) are used so as to perform the display of 256 grayscales.

FIG. 3 is a diagram for describing a driving method of the conventional plasma display device.

As shown in FIG. 2 and FIG. 3, each of the sub-fields (for example, SF1 to SF8) is comprised of a reset period (initialization process) TR in which wall charges (charging state) of all cells in the display region are made uniform, an address period (address process) TA in which wall charges are formed in the cells to be lit so as to select the lighting cells, and a sustain period (display process) TS in which the lighting cells in which the wall charges are formed are discharged (lit) as many times depending on the luminance thereof. The cells are lit in accordance with the luminance of display of each sub-field. For example, the display of one field is performed through the displays of the eight sub-fields (SF1 to SF8).

More specifically, in the reset period TR, first, discharges are generated in all cells by pulses P1 so as to write wall charges thereto, and discharges which remove the wall charges of all the cells are generated by subsequent pulses P2 so as to adjust the charging state to zero. In this event, in the reset period TR, obtuse waves (obtuse-wave reset) in which the voltage gradually varies along with the time course are used as the pulses P1 applied to the Y electrodes for generating the discharges in all the cells, so as to reduce the background light emission and improve the contrast.

Furthermore, in the address period TA, scan pulses SCP are sequentially applied to the Y electrodes (14, 15), and at the same time, address pulses ADP are applied to the cells to be lit based on display data, so as to cause the address discharge and form the wall charges.

Then, in the sustain period TS, sustain discharge pulses (display discharge pulses) STP are applied to the X electrodes and Y electrodes (display electrodes), and only the cells in which the wall charges have been formed by the address discharge are lit. The luminance of the cells is controlled depending on the number of times of the sustain discharge pulses.

FIG. 4 is a block diagram schematically showing the entire structure of an example of a conventional plasma display device, in which an example of a plasma display device 100 using the PDP 10 shown in FIG. 1 is schematically shown.

The plasma display device 100 has the PDP 10, an X driver 32, a Y driver 33, and an address driver 34 for driving the cells of the PDP 10, and a control circuit 31 for controlling the drivers. Field data Df which is multi-valued image data representing luminance levels of three colors of R, G, and B and various synchronization signals (clock signal CLK, horizontal synchronization signal Hsync, and vertical synchronization signal Vsync) from external devices such as a TV tuner and a computer are inputted to the control circuit 31. In accordance with the field data Df and the various synchronization signals, the control circuit 31 outputs control signals suitable for the drivers 32 to 34 so as to perform predetermined image displays.

The Y driver 33 controls the Y electrodes and has a scan driver (scan driver LSI) 331 and a common driver 332. Also, the X driver 32 controls the X electrodes and has a common driver 320.

Conventionally, in order to prevent generation of bright defects and the like in a dark screen even when intervals between discharge cells are narrow and to reliably execute the reset discharge in a bright screen, a method of driving a plasma display device has been proposed, in which the ratio of light-emitting pixels in one screen is detected and inputted to a control pulse power supply, and in accordance with the ratio of light-emitting pixels, sub-field reset voltages are reduced in the image of low ratio and sub-field reset voltages are increased in the image of high ratio (for example, see Japanese Patent Application Laid-Open Publication No. 2000-029431 (Patent Document 1)).

Also, conventionally, in order to reduce the background light emission of an ALIS panel to improve the darkroom contrast, a method of driving a plasma display device has been proposed, in which at least a write discharge step and an elimination discharge step are provided in a reset period, and voltages in the write discharge step are varied at least in a part of sub-fields (for example, see Japanese Patent Application Laid-Open Publication No. 2003-050562 (Patent Document 2)).

SUMMARY OF THE INVENTION

Conventionally, as a reset waveform in a plasma display device, for example, rectangular-wave reset has been used. For example, as described in patent document 1, the technology in which power supply voltages for reset are varied depending on display images has been proposed. However, the case where obtuse-wave reset in which the voltage gradually varies along with time is used as the reset waveform and the sustain time of the achieved potential in the obtuse-wave reset have not been taken into consideration.

Also, in a plasma display device, when reset is performed by a rectangular wave, discharge intensity becomes higher and background light emission is increased. Therefore, conventionally, reset using the obtuse wave has been performed to reduce the background light emission and improve the contrast. However, more enhancement of the contrast has been required so as to improve the image quality.

An object of the present invention is to provide a plasma display device and a driving method thereof which can further improve the contrast and provide high-quality video images.

A first aspect of the present invention provides a driving method of a plasma display device using obtuse-wave reset, in which sustain time of an achieved potential of the obtuse-wave reset is controlled in accordance with a display ratio of a video signal.

A second aspect of the present invention provides a plasma display device comprising: a plasma display panel; a display ratio detecting circuit for detecting a display ratio of a video signal given to the plasma display panel; a reset circuit for resetting the plasma display panel by obtuse-wave reset; and an achieved potential sustain time setting circuit for controlling sustain time of an achieved potential of the obtuse-wave reset in accordance with the display ratio of the video signal.

According to the present invention, it is possible to provide a plasma display device and a driving method thereof which can reduce background light emission and improve contrast in a screen, in which contrast is required, by controlling the sustain time of a reset achieved potential in accordance with a display image.

BRIEF DESCRIPTIONS OF THE DRAWINGS

DESCRIPTIONS OF THE PREFERRED EMBODIMENTS

In a plasma display device and a driving method thereof according to the present invention, the sustain time of an achieved potential in obtuse-wave reset is controlled so that the sustain time is lengthened when the load is high, for example, in the case of a white display screen in which voltage drop occurs at the time of reset and the sustain time is shortened when the load is low in which voltage drop does not occur at the time of reset. Accordingly, it is possible to suppress background light emission and improve image quality at the time of low load where contrast is necessary.

(Embodiment)

Figure 5:
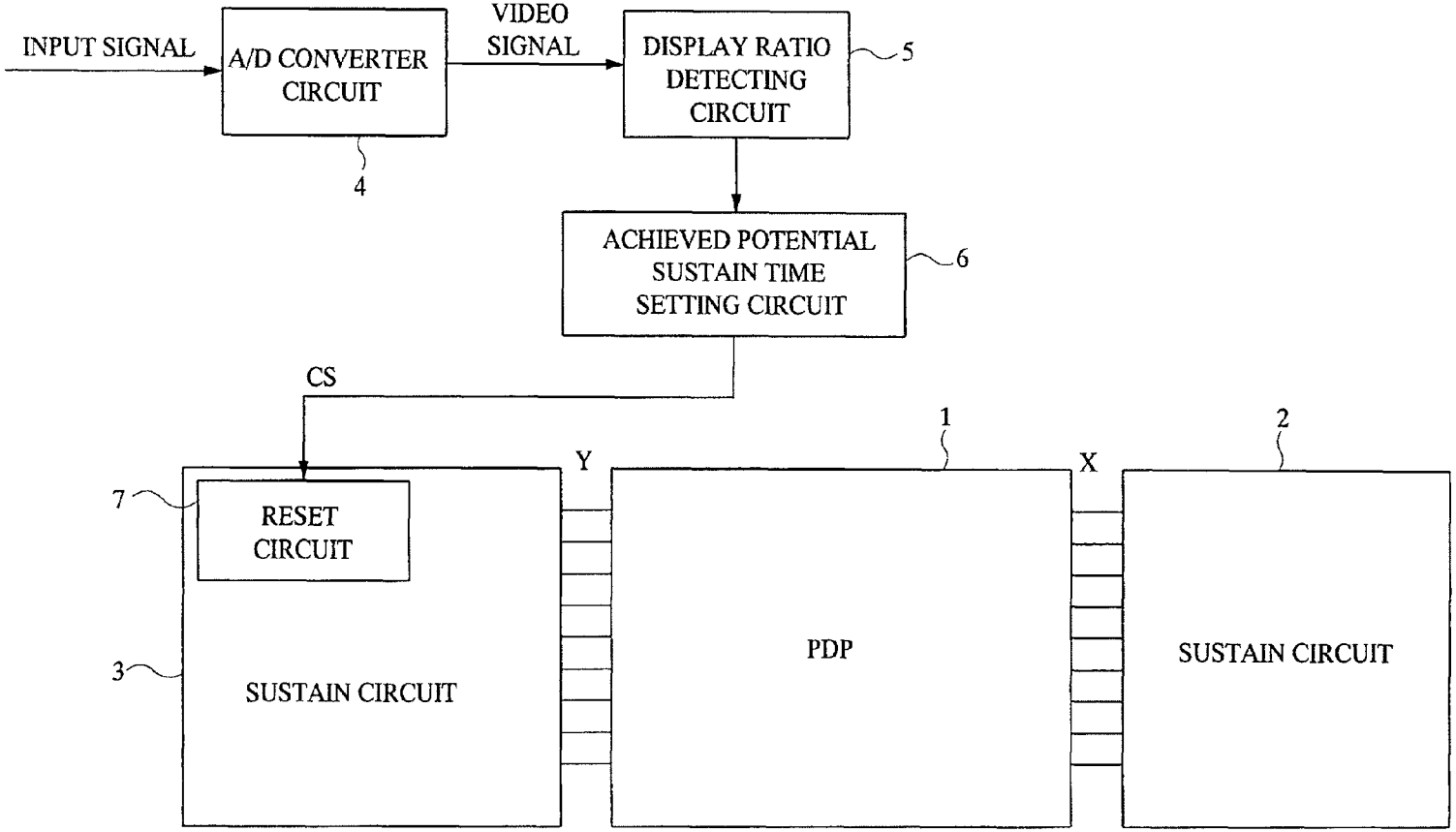
FIG. 5 is a block diagram schematically showing an embodiment of a plasma display device according to the present invention.

Hereinafter, embodiments of a plasma display device and a driving method thereof according to the present invention will be described in detail with reference to appended drawings. 026*a* FIG. 5 is a block diagram schematically showing an embodiment of a plasma display device according to the present invention.

In FIG. 5, a reference numeral 1 denotes a plasma display panel (PDP), 2 denotes a sustain circuit for X electrodes, 3 denotes a sustain circuit for Y electrodes, 4 denotes an A/D converter circuit, 5 denotes a display ratio detecting circuit, 6 denotes an achieved potential sustain time setting circuit, and 7 denotes a reset circuit. Note that the sustain circuit 2 for X electrodes and the sustain circuit 3 for Y electrodes correspond to the common drivers 332 and 320 in FIG. 4, respectively. Also, the A/D converter circuit 4 and the display ratio detecting circuit 5 are provided in a place corresponding to the control circuit 31 in FIG. 4.

Figure 4:
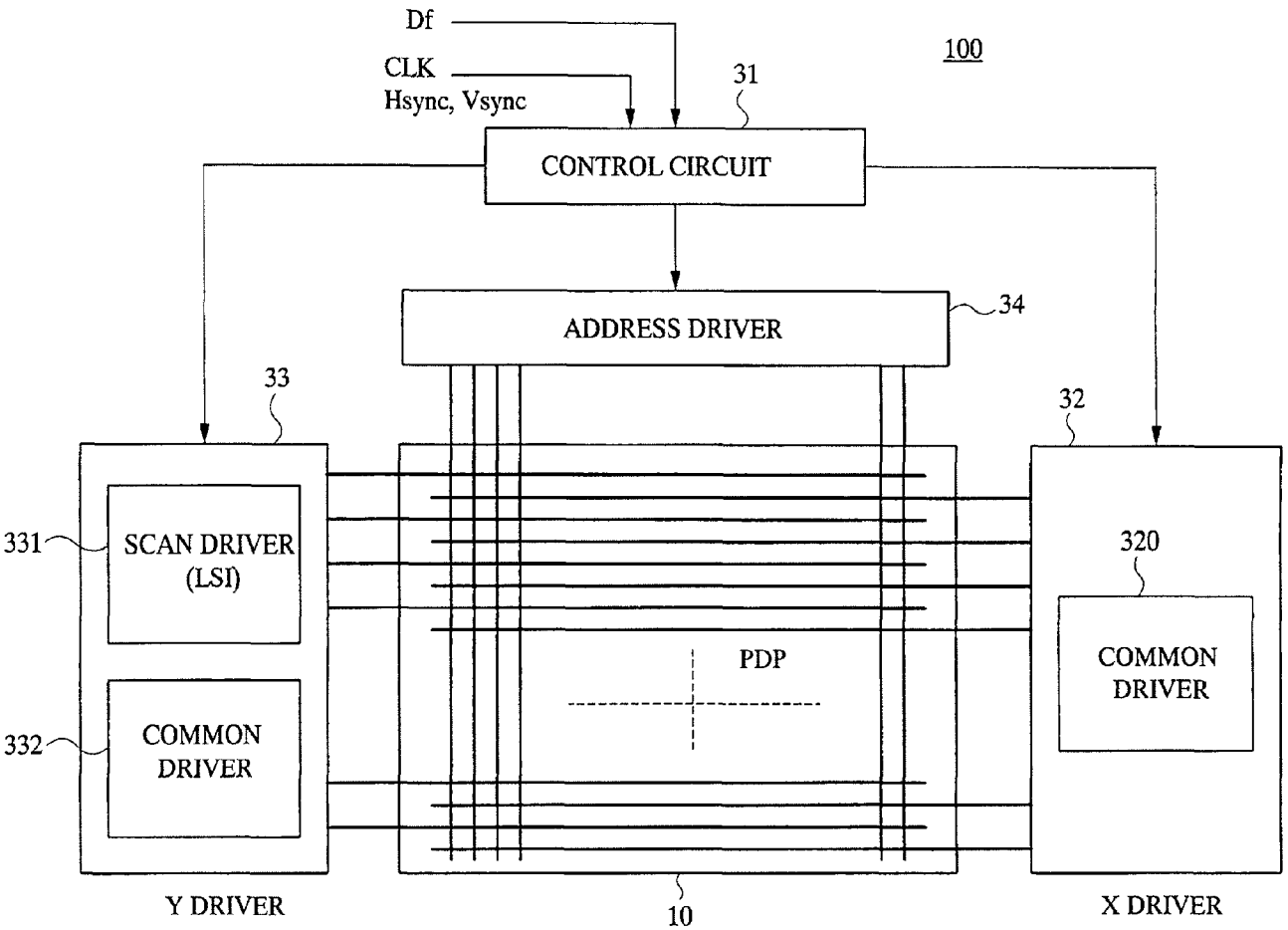
FIG. 4 is a block diagram schematically showing the entire structure of an example of a conventional plasma display device.

In other words, the plasma display device of this embodiment corresponds to a device in which the achieved potential sustain time setting circuit 6 is newly provided to the conventional plasma display device shown in FIG. 4.

The A/D converter circuit 4 subjects an input signal (field data Df) supplied from outside to analog/digital conversion, and outputs a video signal to the display ratio detecting circuit 5. The display ratio detecting circuit 5 detects the display ratio of the video signal given to the PDP 1.

The achieved potential sustain time setting circuit 6 sets the sustain time of the achieved potential of obtuse-wave reset in accordance with the display ratio of the video signal detected by the display ratio detecting circuit 5, and it controls the sustain time of the achieved potential of the obtuse-wave reset via the reset circuit 7.

More specifically, when the display ratio is high and the load factor is high, the achieved potential sustain time setting circuit 6 inputs a control signal which lengthens the sustain time of the reset achieved potential to the reset circuit 7 in the sustain circuit 3. Also, when the display ratio is low and the load factor is low, it inputs a control signal which shortens the sustain time of the reset achieved potential to the reset circuit 7 in the sustain circuit 3.

The reset circuit 7 receives the control signal from the achieved potential sustain time setting circuit 6, and controls the sustain time of the achieved potential of obtuse-wave reset in accordance with the display ratio of the video signal, for example, by controlling the on-time of a switch.

Figure 1:
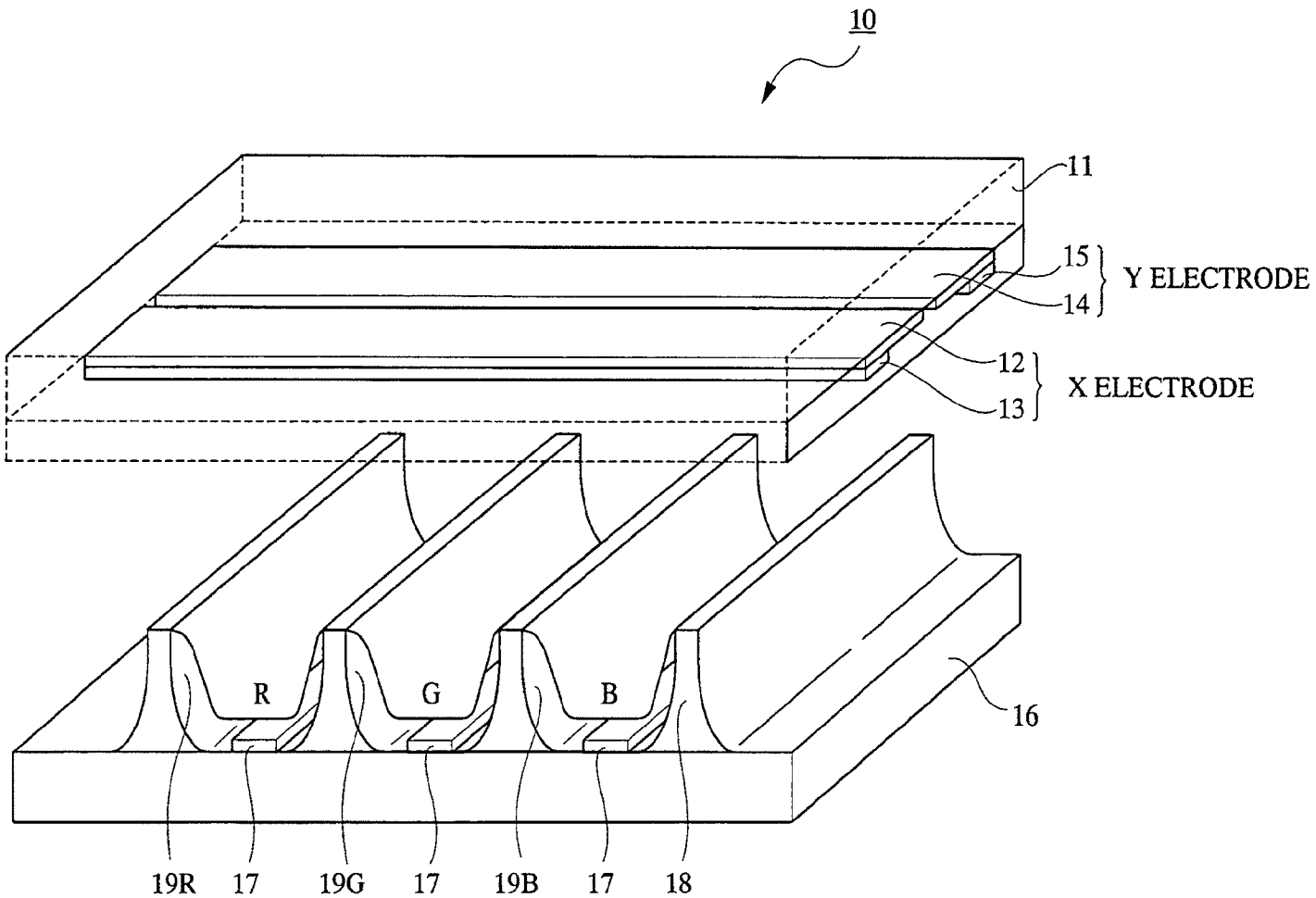
FIG. 1 is a diagram schematically showing an example of a conventional plasma display panel.
Figure 2:
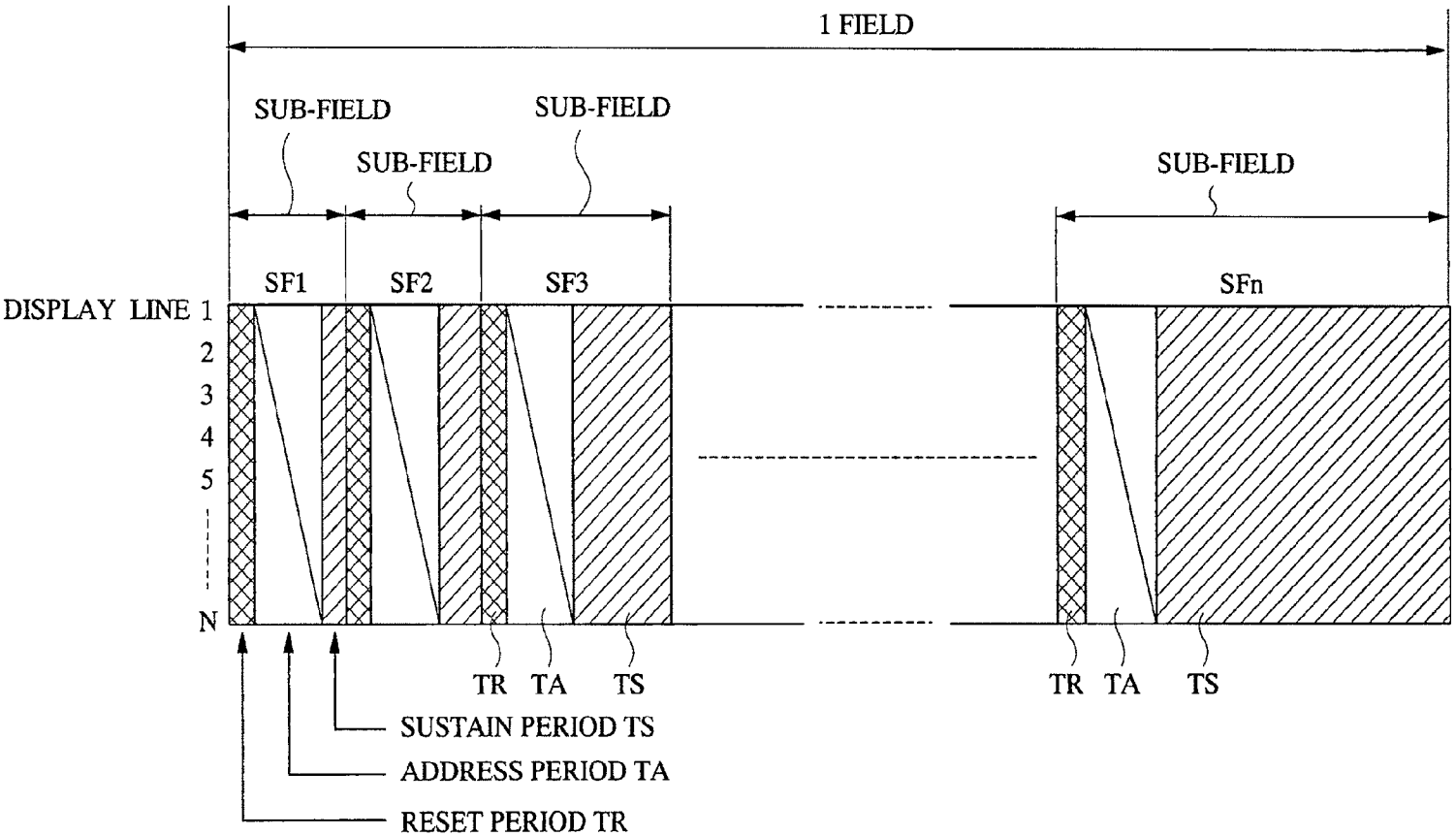
FIG. 2 is a diagram showing an example of a grayscale driving sequence in a conventional plasma display device.
Figure 3:
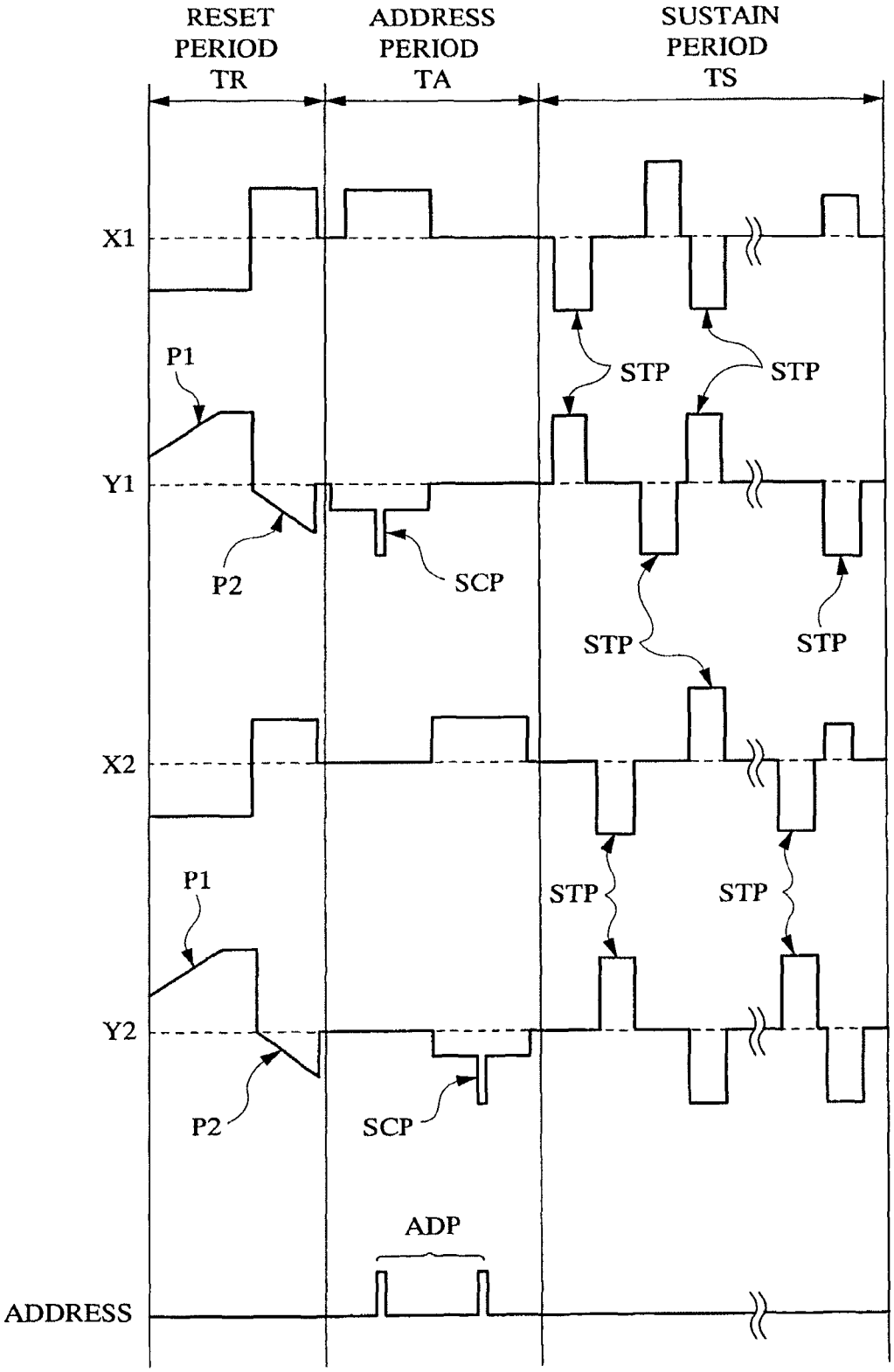
FIG. 3 is a diagram showing driving waveforms in an example of a conventional plasma display device.
Figure 6:
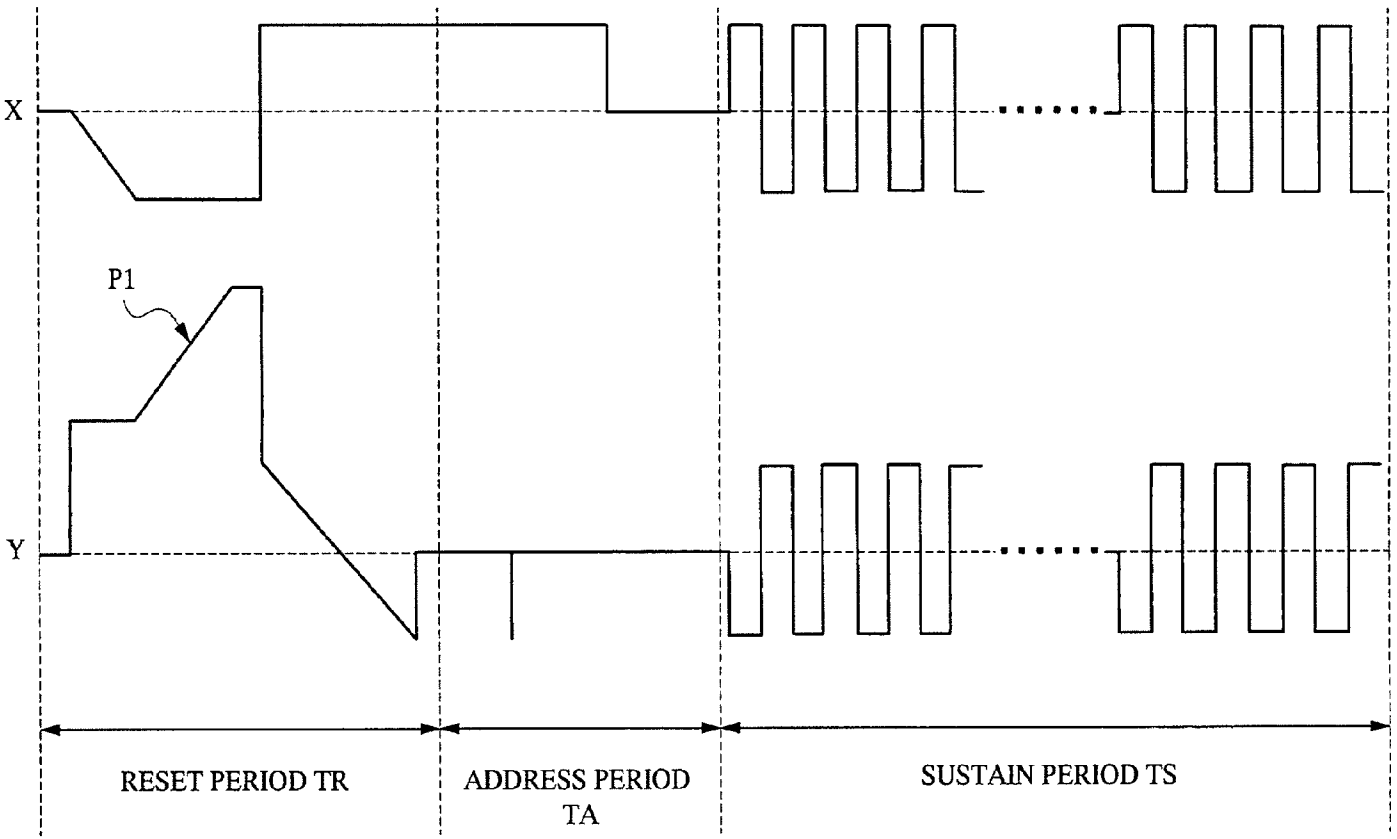
FIG. 6 is a diagram showing driving waveforms in an embodiment of the plasma display device according to the present invention.
Figure 7:
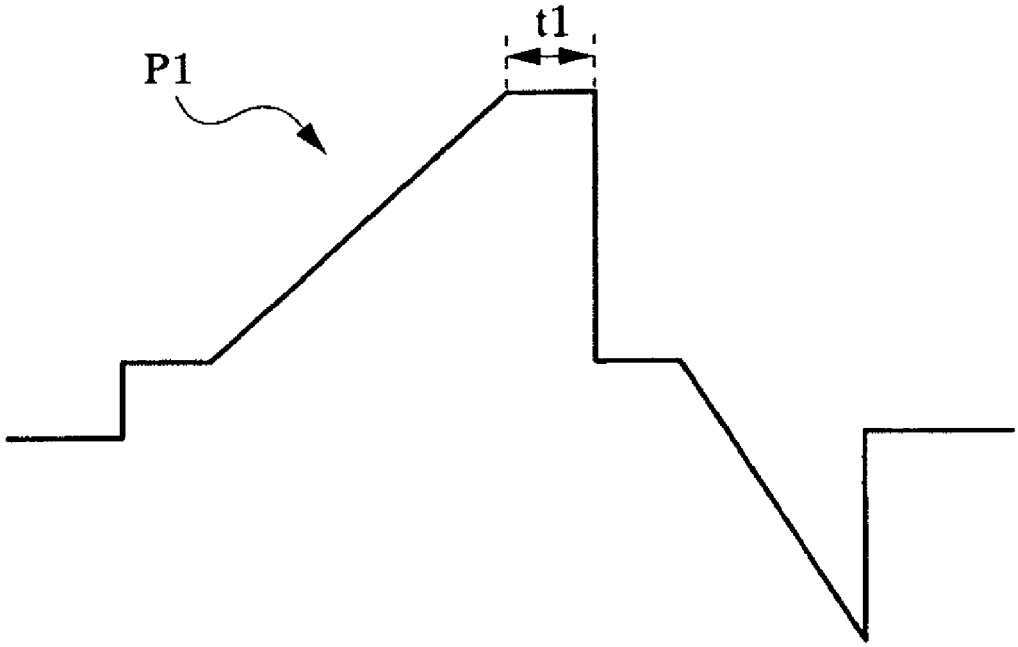
FIG. 7 is a diagram schematically showing a waveform of obtuse-wave reset.

FIG. 6 is a diagram schematically showing driving waveforms in an embodiment of the plasma display device according to the present invention, and FIG. 7 is a diagram schematically showing a waveform of the obtuse-wave reset. The plasma display device of this embodiment is driven by use of the obtuse-wave reset similar to the conventional plasma display device described with reference to FIG. 3.

More specifically, as shown in FIG. 6, each of the driving waveforms of the plasma display device of this embodiment is comprised of a reset period TR, an address period TA, and a sustain period TS. The reset period TR is a period for changing previous wall charge states into a uniform state in all the cells, in which the larger the number of cells which have performed the discharge (the higher the display ratio), the higher the possibility of reducing the reset potential. Therefore, as shown in FIG. 7, the waveform of the obtuse-wave reset (reset pulse P1) requires a predetermined sustain time t1 which is provided after a reset potential is achieved.

In a driving method of a plasma display device according to the present invention, the sustain time (sustain time of an achieved potential of obtuse-wave reset) t1 in the reset pulse P1 shown in FIG. 7 is changed in accordance with the display ratio of the video signal.

More specifically, when the display ratio is high and reset discharge has to be increased, the sustain time t1 is lengthened so that insufficient reset due to voltage drop is not caused. Also, when the display ratio is low and reset discharge is reduced, the sustain time is shortened so that background light emission due to reset discharge is reduced, and high contrast can be realized. Note that the above-described control of the sustain time of the achieved potential of the obtuse-wave reset, that is, control of the sustain time of the achieved potential of the obtuse-wave reset performed by changing the achieved potential or slope of the obtuse-wave reset is preferably performed for, for example, each sub-field (SF).

Figure 8A:
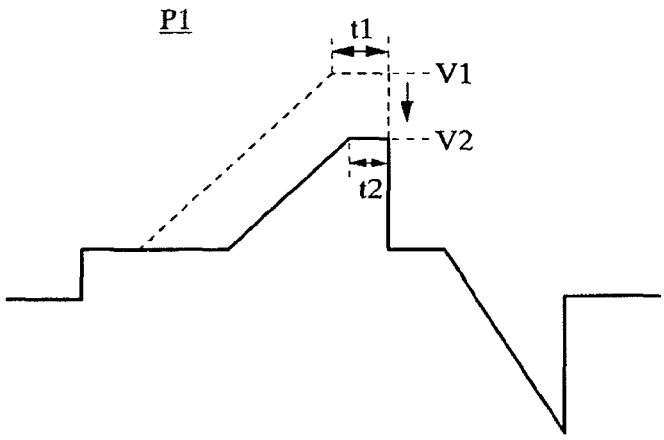
FIG. 8A is a diagram (No. 1) schematically showing an example of the waveform of obtuse-wave reset in the plasma display device according to the present invention.
Figure 8B:
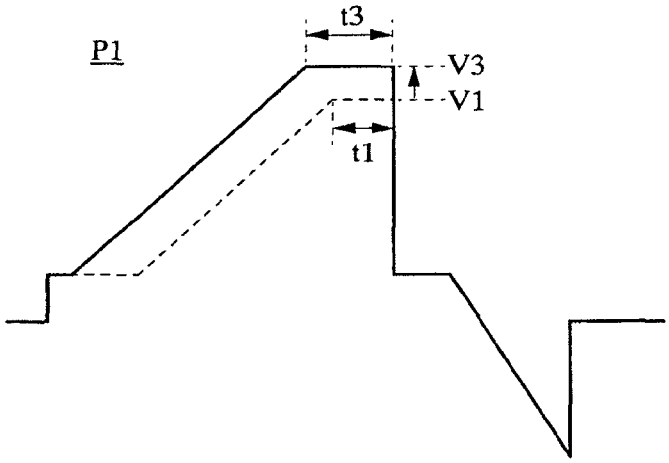
FIG. 8B is a diagram (No. 1) schematically showing an example of the waveform of obtuse-wave reset in the plasma display device according to the present invention.

FIG. 8A and FIG. 8B are diagrams (No. 1) schematically showing examples of the waveforms of obtuse-wave reset in the plasma display device according to the present invention. FIG. 8A shows a waveform of the case where the display ratio is low, and FIG. 8B shows a waveform of the case where the display ratio is high.

First, as shown in FIG. 8A, when the display ratio of a video signal is low, the achieved potential of obtuse-wave reset is lowered from V1 to V2 so that the sustain time of the achieved potential of the obtuse-wave reset is shortened from t1 to t2. Consequently, when the display ratio of the video signal is low, background light emission is suppressed, and an image of high contrast can be obtained.

Also, as shown in FIG. 8B, when the display ratio of a video signal is high, the achieved potential of obtuse-wave reset is increased from V1 to V3 so that the sustain time of the achieved potential of the obtuse-wave reset is lengthened from t1 to t3. Consequently, even when the display ratio of the video signal is high, a stable reset operation can be performed.

However, the sustain time is lengthened in some cases in order to prevent insufficient reset due to voltage drop resulting from the reduction of the achieved potential of obtuse-wave reset. Moreover, when the display ratio of a video signal is high, the achieved potential of obtuse-wave reset is increased, and if the reset is stabilized, the sustain time can be correspondingly shortened in some cases.

Figure 9A:
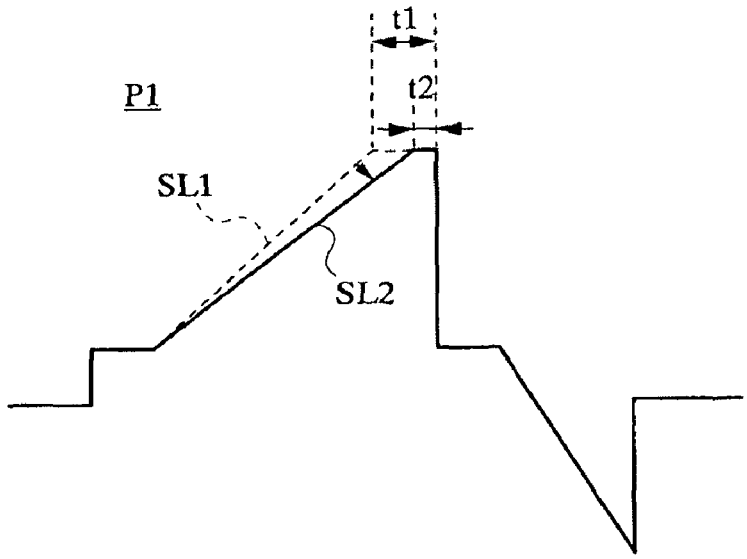
FIG. 9A is a diagram (No. 2) schematically showing another example of the waveform of obtuse-wave reset in the plasma display device according to the present invention.
Figure 9B:
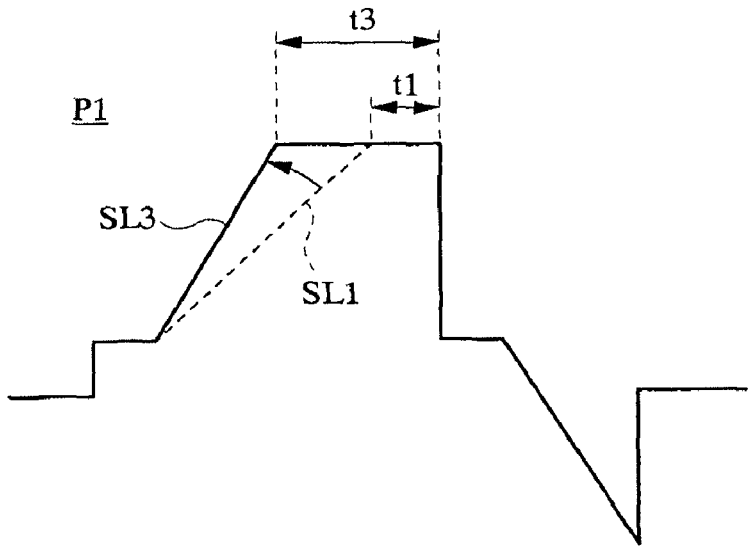
FIG. 9B is a diagram (No. 2) schematically showing another example of the waveform of obtuse-wave reset in the plasma display device according to the present invention.

FIG. 9A and FIG. 9B are diagrams (No. 2) schematically showing examples of the waveforms of obtuse-wave reset in the plasma display device according to the present invention. FIG. 9A shows a waveform of the case where the display ratio is low, and FIG. 9B shows a waveform of the case where the display ratio is high.

As shown in FIG. 9A, when the display ratio of a video signal is low, the slope of obtuse-wave reset is relaxed from SL1 to SL2 so that the achieved potential of the obtuse-wave reset is shortened from t1 to t2. Consequently, when the display ratio of the video signal is low, background light emission is suppressed, and an image of high contrast can be obtained.

As shown in FIG. 9B, when the display ratio of a video signal is high, the slope of obtuse-wave reset is made steeper from SL1 to SL3 so that the sustain time of the achieved potential of the obtuse-wave reset is lengthened from t1 to t3. Consequently, even when the display ratio of the video signal is high, a stable reset operation can be performed.

Figure 10:
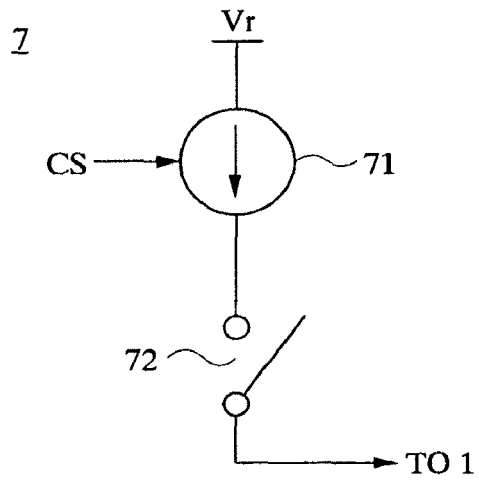
FIG. 10 is a diagram schematically showing an example of a reset circuit in the plasma display device according to the present invention.

FIG. 10 is a diagram schematically showing an example of the reset circuit in the plasma display device according to the present invention. In FIG. 10, a reference numeral 71 denotes a constant current source, 72 denotes a switch element, and Vr denotes a reset voltage, respectively.

As shown in FIG. 10, the reset circuit 7 of this example has the constant current source 71 and the switch element 72, and charges the panel 1 serving as a capacitance (C) with a constant current of the constant current source 71, thereby increasing the voltage with a constant slope. Moreover, the slope of the obtuse-wave reset can be controlled by changing the current value of the constant current source 71 by a control signal CS from the achieved potential sustain time setting circuit 6. In addition, the sustain time of the achieved potential of obtuse-wave reset can be controlled by changing the on-time of the switch element 72.

Figure 11:
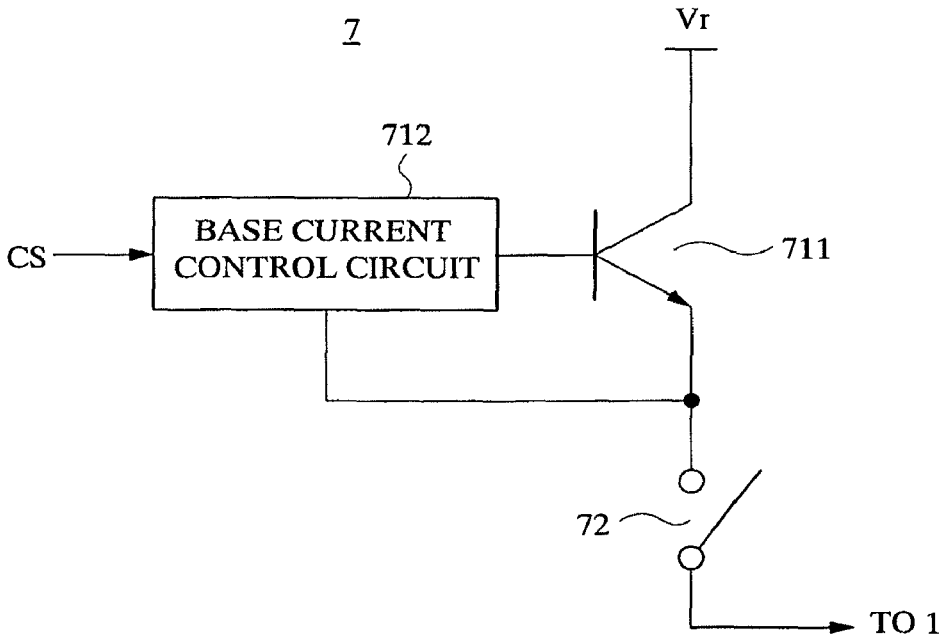
FIG. 11 is a diagram schematically showing another example of the reset circuit in the plasma display device according to the present invention.

FIG. 11 is a diagram schematically showing another example of the reset circuit in the plasma display device according to the present invention.

As shown in FIG. 11, the reset circuit 7 of this example has a transistor 711, a base current control circuit 712, and the switch element 72, in which the control signal CS from the achieved potential sustain time setting circuit 6 is inputted to the base current control circuit 712. Also, by controlling the base current of the transistor 711 by the base current control circuit 712, the slope of the obtuse-wave reset can be controlled.

More specifically, the base current control circuit 712 detects and controls the collector current of the transistor 711 so that the slope of obtuse-wave reset is controlled to two or three different angles. Furthermore, the base current of the transistor 711 can be controlled, for example, by changing the on/off period (duty) of a control pulse of the transistor 711. In addition, as described above, the sustain time of the achieved potential of obtuse-wave reset can be controlled by changing the on-time of the switch element 72.

Figure 12:
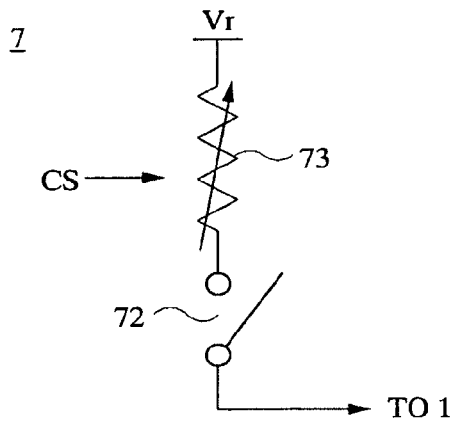
FIG. 12 is a diagram schematically showing still another example of the reset circuit in the plasma display device according to the present invention.

FIG. 12 is a diagram schematically showing still another example of the reset circuit in the plasma display device according to the present invention.

As shown in FIG. 12, the reset circuit 7 of this example has a variable resistive element 73 instead of the constant current source 71 in the reset circuit shown in FIG. 10. The resistance value of the variable resistive element 73 is controlled by the control signal CS from the achieved potential sustain time setting circuit 6, that is, controlled in accordance with the display ratio of a video signal, thereby changing the waveform of obtuse-wave reset. In this case, R (resistance) of CR that changes the waveform of the obtuse-wave reset is obviously the variable resistive element 73, and C (capacitance) thereof is the discharge cell of the PDP 1. Thus, two or more waveforms of the obtuse-wave reset can be provided by controlling the resistance value of the variable resistive element 73 by the control signal CS from the achieved potential sustain time setting circuit 6.

Figure 13:
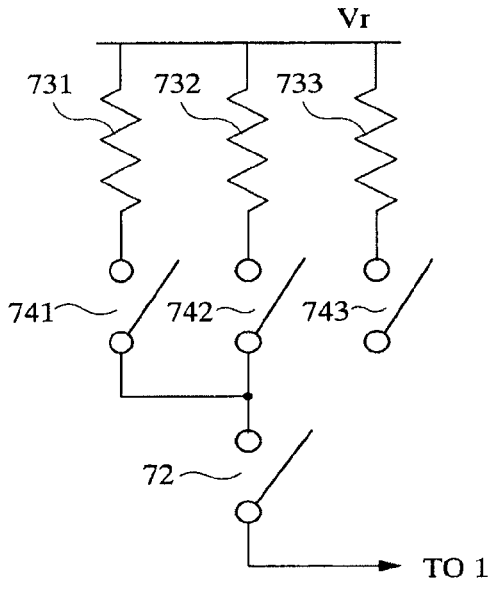
FIG. 13 is a diagram schematically showing still another example of the reset circuit in the plasma display device according to the present invention.

FIG. 13 is a diagram schematically showing still another example of the reset circuit in the plasma display device according to the present invention.

As shown in FIG. 13, the reset circuit 7 of this example has three sets of resistive elements and switch elements 731 and 741, 732 and 742, and 733 and 743 instead of the variable resistive element 73 in the reset circuit shown in FIG. 12. In this case, all of the resistance values $R_{731}$, $R_{732}$, and $R_{733}$ of the resistive elements 731, 732, and 733 may be the same value ($R_{731}$:$R_{732}$:$R_{733}$=1:1:1). Alternatively, the resistance values may be, for example, the values having the ratio of powers of 2 ($R_{731}$:$R_{732}$:$R_{733}$=1:2:4).

Then, by controlling the switch elements 741, 742, and 743 by the control signal CS from the achieved potential sustain time setting circuit 6, the slope of obtuse-wave reset can be changed. Specifically, for example, when the resistance values of the resistive elements 731 to 733 are $R_{731}$:$R_{732}$:$R_{733}$:= 1:1:1, by turning on the two switch elements 741 and 742 at the same time, the slope of the obtuse-wave reset can be relaxed in comparison to the case where the three switch elements 741 to 743 are turned on at the same time. In addition, by turning on only one switch element 741, the slope of the obtuse-wave reset can be further relaxed.

Furthermore, for example, when the timings of turning off the switch elements 741 to 743 are varied with respect to one another, a waveform of the obtuse-wave reset having two or three levels of slope can be obtained. Note that the sustain time of the achieved potential of the obtuse-wave reset can be controlled by changing the on-time of the switch element 72.

In the foregoing description, a three-electrode surface-discharge type plasma display device has been described as the plasma display device according to the present invention. However, the present invention can be applied to various other plasma display devices using obtuse-wave reset.

(Note 1)

In a driving method of a plasma display device using obtuse-wave reset, sustain time of an achieved potential of the obtuse-wave reset is controlled in accordance with a display ratio of a video signal.

(Note 2)

In the driving method of the plasma display device according to note 1, when the display ratio of the video signal is low, the achieved potential of the obtuse-wave reset is lowered to shorten the sustain time of the achieved potential of the obtuse-wave reset.

(Note 3)

In the driving method of the plasma display device according to note 1, when the display ratio of the video signal is high, the achieved potential of the obtuse-wave reset is increased to lengthen the sustain time of the achieved potential of the obtuse-wave reset.

(Note 4)

In the driving method of the plasma display device according to note 1, when the display ratio of the video signal is low, a slope of the obtuse-wave reset is relaxed to shorten the sustain time of the achieved potential of the obtuse-wave reset.

(Note 5)

In the driving method of the plasma display device according to note 1, when the display ratio of the video signal is high, a slope of the obtuse-wave reset is made steeper to lengthen the sustain time of the achieved potential of the obtuse-wave reset.

(Note 6)

In the driving method of the plasma display device according to note 1, the sustain time of the achieved potential of the obtuse-wave reset is controlled in each sub-field.

(Note 7)

In the driving method of the plasma display device according to note 6, the achieved potential or the slope of the obtuse-wave reset is controlled for each sub-field so as to control the sustain time of the achieved potential of the obtuse-wave reset.

(Note 8)

In the driving method of the plasma display device according to note 1, a waveform of the obtuse-wave reset is changed in accordance with a time constant of CR so as to control the sustain time of the achieved potential of the obtuse-wave reset.

(Note 9)

In the driving method of the plasma display device according to note 8, at least two waveforms of the obtuse-wave reset changed in accordance with the CR are provided.

(Note 10)

In the driving method of the plasma display device according to note 9, two waveforms of the obtuse-wave reset changed in accordance with the CR are provided.

(Note 11)

A plasma display device comprises: a plasma display panel; a display ratio detecting circuit for detecting a display ratio of a video signal given to the plasma display panel; a reset circuit for resetting the plasma display panel by obtuse-wave reset; and an achieved potential sustain time setting circuit for controlling sustain time of an achieved potential of the obtuse-wave reset in accordance with the display ratio of the video signal, wherein the sustain time of the achieved potential of the obtuse-wave reset is controlled.

(Note 12)

In the plasma display device according to note 11, when the display ratio of the video signal is low, the achieved potential sustain time setting circuit supplies a control signal to the reset circuit so as to lower the achieved potential of the obtuse-wave reset, thereby shortening the sustain time of the achieved potential of the obtuse-wave reset.

(Note 13)

In the plasma display device according to note 11, when the display ratio of the video signal is high, the achieved potential sustain time setting circuit supplies a control signal to the reset circuit so as to increase the achieved potential of the obtuse-wave reset, thereby lengthening the sustain time of the achieved potential of the obtuse-wave reset.

(Note 14)

In the plasma display device according to note 11, when the display ratio of the video signal is low, the achieved potential sustain time setting circuit supplies a control signal to the reset circuit so as to relax the slope of the obtuse-wave reset, thereby shortening the sustain time of the achieved potential of the obtuse-wave reset.

(Note 15)

In the plasma display device according to note 11, when the display ratio of the video signal is high, the achieved potential sustain time setting circuit supplies a control signal to the reset circuit so as to make the slope of the obtuse-wave reset steeper, thereby lengthening the sustain time of the achieved potential of the obtuse-wave reset.

(Note 16)

In the plasma display device according to note 11, the achieved potential sustain time setting circuit controls the sustain time of the achieved potential of the obtuse-wave reset in each sub-field.

(Note 17)

In the plasma display device according to note 16, the achieved potential sustain time setting circuit controls the sustain time of the achieved potential of the obtuse-wave reset by changing the achieved potential or slope of the obtuse-wave reset in each sub-field.

(Note 18)

In the plasma display device according to note 11, the achieved potential sustain time setting circuit changes a waveform of the obtuse-wave reset in accordance with a time constant of CR so as to control the sustain time of the achieved potential of the obtuse-wave reset.

(Note 19)

In the plasma display device according to note 18, the achieved potential sustain time setting circuit provides at least two waveforms of the obtuse-wave reset changed in accordance with the CR.

(Note 20)

In the plasma display device according to note 19, two waveforms of the obtuse-wave reset changed in accordance with the CR are provided.

(Note 21)

In the plasma display device according to note 11, the reset circuit has a current source and a switch element controlled by a control signal.

(Note 22)

The plasma display device according to note 11, the reset circuit has a variable resistive element and a switch element controlled by a control signal.

(Note 23)

In the plasma display device according to note 11, the reset circuit has multiple sets of resistive elements and switch elements controlled by a control signal, and a switch element.

The present invention can be applied to various plasma display devices such as three-electrode surface-discharge type plasma display devices using obtuse-wave reset. The plasma display devices are utilized as, for example, display devices of personal computers, workstations, and others, flat wall-hung televisions, or image display devices for displaying advertisements, information, and the like.

What is claimed is:

1. A driving method of a plasma display device having a reset period including a first period where a waveform in which a voltage is increased in time is applied and a second period where a maximum achieved voltage value of the waveform in which the voltage is increased is maintained, wherein an amount of voltage increase per unit time of the waveform in which the voltage is increased in a case where a display ratio of an input signal is a first display ratio and the amount of voltage increase in a case where the display ratio is a second display ratio higher than the first display ratio are set substantially equal to each other, and wherein the second period is lengthened more in the case of the second display ratio than in the case of the first display ratio.

2. The driving method of the plasma display device according to claim 1, wherein the first period is lengthened more in the case of the second display ratio than in the case of the first display ratio, thereby increasing the maximum achieved voltage value.

3. The driving method of the plasma display device according to claim 1, wherein the first period is set substantially equal in the case of the second display ratio and the case of the first display ratio, thereby setting the maximum achieved voltage values substantially equal to each other.

4. The driving method of the plasma display device according to claim 1, wherein the amount of voltage increase per unit time of the waveform in which the voltage is increased in time is set substantially constant by using a constant current source.

5. The driving method of the plasma display device according to claim 4, wherein the second period is controlled by changing an on-time of a switch element disposed on an output side of the constant current source.

6. The driving method of the plasma display device according to claim 5, wherein the reset period further includes a period where a waveform in which a voltage is decreased in time is applied.

7. A plasma display device comprising:

a plasma display panel having a plurality of X and Y electrodes extending in a first direction and a plurality of address electrodes extending in a second direction intersecting the first direction;

a circuit for detecting a display ratio of an input signal;

a circuit for applying, to the Y electrodes, a reset waveform including a waveform in which a voltage is increased in time; and a control circuit for controlling the circuit for applying the reset waveform, wherein the control circuit controls to maintain a maximum achieved voltage value of the waveform in which the voltage is increased, wherein an amount of voltage increase per unit time of the waveform in which the voltage is increased in a case where a display ratio of the input signal is a first display ratio and the amount of voltage increase in a case where the display ratio is a second display ratio higher than the first display ratio are set substantially equal to each other, and wherein a period in which the maximum achieved voltage value is maintained is lengthened more in the case of the second display ratio than in the case of the first display ratio.

8. The plasma display device according to claim 7, wherein the control circuit controls to lengthen the first period more in the case of the second display ratio than in the case of the first display ratio, thereby increasing the maximum achieved voltage value.

9. The plasma display device according to claim 7, wherein the control circuit controls the first period so as to be substantially equal in the case of the second display ratio and the case of the first display ratio, thereby setting the maximum achieved voltage values substantially equal to each other.

10. The plasma display device according to claim 7, wherein, in the circuit for applying the reset waveform, a power supply, a constant current source and a switch element are disposed in this order, and wherein the control circuit controls the second period by changing an on-time of the switch element.

* * * * *